United States Patent [19]

Topalian et al.

[11] Patent Number: 4,516,282

[45] Date of Patent: May 14, 1985

[54] SUPPORT FOR A PREMATURE INFANT

[76] Inventors: Joan A. Topalian, 125 Newbritian Dr., Warwick, R.I. 02889; Ronald L. Izen, Stillwater Rd., Smithfield, R.I. 02917

[21] Appl. No.: 310,456

[22] Filed: Oct. 13, 1981

[51] Int. Cl.[3] ..... A61G 7/06

[52] U.S. Cl. ..... 5/72; 5/433; 5/66; 297/355; 16/386; 16/361

[58] Field of Search ..... 5/37 R, 93 R, 101, 66, 5/82 R, 72, 431–433, 75, 77, 79, 443; 297/355, 357; 16/386, 361

[56] References Cited

U.S. PATENT DOCUMENTS

| | | | |
|---|---|---|---|
| 1,215,609 | 2/1917 | Arnold | 297/355 |
| 1,722,408 | 7/1929 | Brabec | 297/355 |
| 2,281,629 | 5/1942 | Snow | 5/431 |
| 2,823,737 | 2/1958 | Eriksen | 5/93 R |
| 2,947,350 | 8/1960 | Davis | 297/355 |
| 2,973,889 | 3/1961 | Phillips | 5/82 |
| 3,049,376 | 8/1962 | Rosenthal | 5/37 R |
| 3,066,981 | 12/1962 | Welsh | 5/66 |
| 3,076,628 | 2/1958 | Smith et al. | 297/357 |
| 3,107,120 | 10/1963 | Linden | 5/66 |
| 3,132,897 | 5/1964 | Linden | 5/66 |
| 3,269,621 | 8/1966 | Dishart | 5/434 |

FOREIGN PATENT DOCUMENTS

| | | | |
|---|---|---|---|
| 1320648 | 4/1962 | France | 297/357 |

*Primary Examiner*—Gary L. Smith
*Assistant Examiner*—Michael F. Trettel
*Attorney, Agent, or Firm*—Robert T. Gammons

[57] ABSTRACT

A device for supporting premature infants while in an incubator comprising a convex supporting surface structured to accommodate the thigh and leg structure, a flat mobile supporting surface structured to accommodate the back structure and a supporting frame supporting the stationary and mobile surfaces with the mobile surface hinged so as to be movable angularly relative to the stationary surface upwardly and downwardly.

8 Claims, 5 Drawing Figures

SUPPORT FOR A PREMATURE INFANT

BACKGROUND OF INVENTION

Conventionally, premature infants, while in an incubator, are supported therein on flexible pads which have the disadvantages that it is not possible to position the infant in the most comfortable posture according to its condition or to vary the position from time-to-time to compensate for changes in condition nor is it possible to maintain the infant in a given position since there is no lateral support to prevent the infant from sliding off the pad to one side or the other. It is the purpose of this invention to provide a supporting device which will enable placing the infant in the most desirable position from the standpoint of its physical condition and size and for keeping the infant in place in this position until it appears desirable to make a change.

SUMMARY OF INVENTION

As herein illustrated, the support comprises means defining a stationary bottom supporting surface proportioned to accommodate the thigh and leg portions of the body structure, a mobile back-supporting surface dimensioned to accommodate the back structure, means supporting the stationary and mobile supporting surfaces with an end of the mobile structure adjacent an end of the stationary structure, said means comprising spaced, parallel side wall panels coextensive in length with the stationary and mobile supporting surfaces, said stationary supporting surface being fixed at its opposite edges to the respective side wall panels, hinge means connecting the edge of the mobile supporting surface adjacent the stationary supporting surface for angular movement relative to the stationary supporting surface between the side wall panels to raise and lower the mobile supporting surface relative to the stationary supporting surface and means at the distal end of the mobile supporting surface, engageable with means on the side wall panels to support the mobile supporting surface at a selected angle. The stationary supporting surface is convex and crests at approximately the location of the knee joint. The slope of the convex portion of the stationary supporting surface rising from the proximal end to the crest is less than the slope of the convex portion descending from the crest to the distal end. The proximal edges of the mobile and stationary supporting surfaces are slightly concave so as to merge smoothly. The mobile and stationary supporting surfaces are supported between spaced, parallel supporting panels with the edges of the stationary supporting surface fixed to the side wall panels and the proximal edge of the mobile supporting surface being hingedly connected to the side wall panels. Vertically-spaced notches in the ends of the side wall panels and pin means fixed to the distal ends of the mobile supporting surface are selectively engageable with the notches to support the mobile supporting surface at a selected angular position with respect to the stationary supporting surface. Desirably, a flexible pad coextensive in length with the surfaces of the mobile and stationary supporting surfaces is positioned upon said surfaces.

The invention will now be described in greater detail with reference to the accompanying drawings, wherein.

Figure 1:
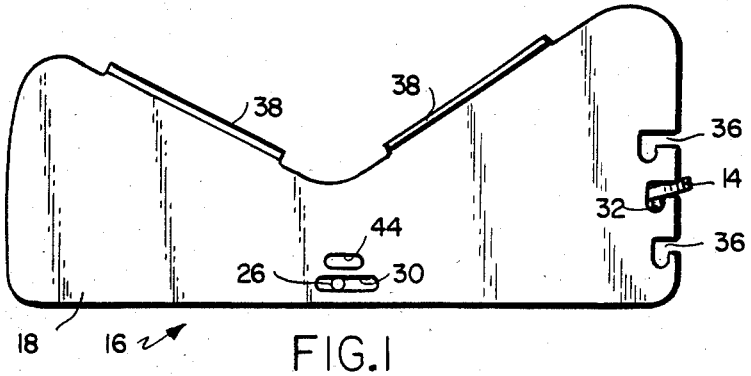
FIG. 1 is an elevation of one side of the device.
Figure 5:
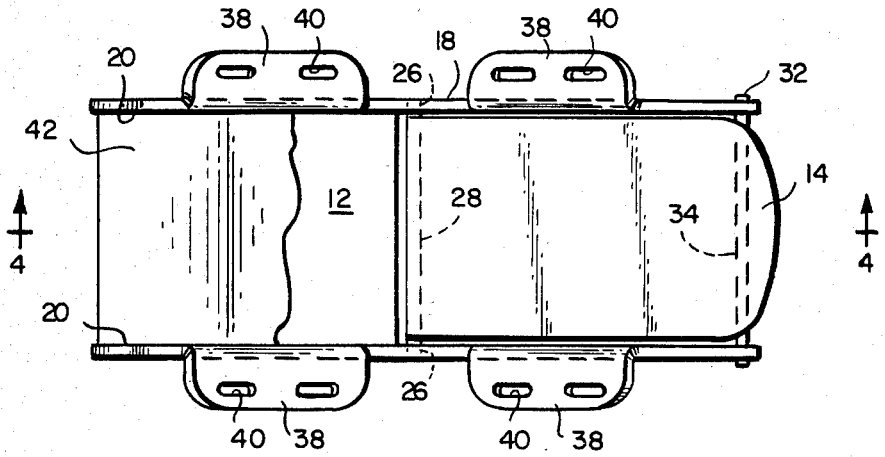
FIG. 5 is a top view.
Figure 2:
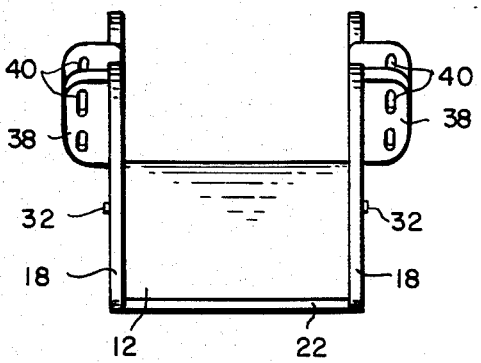
FIG. 2 is an elevation of one end of the device.
Figure 3:
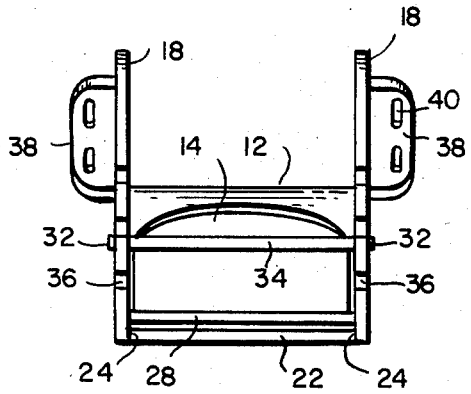
FIG. 3 is an elevation of the other end of the device.

Referring to the drawings, the device comprises essentially body supporting surfaces 12 and 14 and a frame 16 for supporting the body supporting surfaces 12 and 14 for relative angular movement. The body supporting surface 12 is stationarily supported by the supporting structure 16, is of convex configuration, and is structured to support the thighs and legs of the infant from the hips down to the toes. The convex structure crests at approximately $\frac{5}{8}$ of the distance between its opposite ends which corresponds substantially to the proportion of the length of the thighs to the legs of the average human form. Desirably, the portion of the convex surface rising from the lower proximal edge to the crest is approximately 30° to 45° and the slope of the convex portion descending from the crest to the lower distal edge is approximately 40° to 65°.

The mobile supporting surface 14 is structured to support the back of the infant and is substantially flat, except for the end adjacent the stationary supporting surface which is slightly concave so as to merge with the proximal edge of the stationary supporting surface which is correspondingly slightly concave.

The supporting structure 16 comprises spaced, parallel side wall panels 18—18 rigidly connected to each other at one end by the stationary supporting structure 16, the opposite edges 20—20 of which are attached to the inner sides of the side wall panels and at their other ends by a transverse tie 22, the opposite ends 24—24 of which are fastened to the side wall panels.

Figure 4:
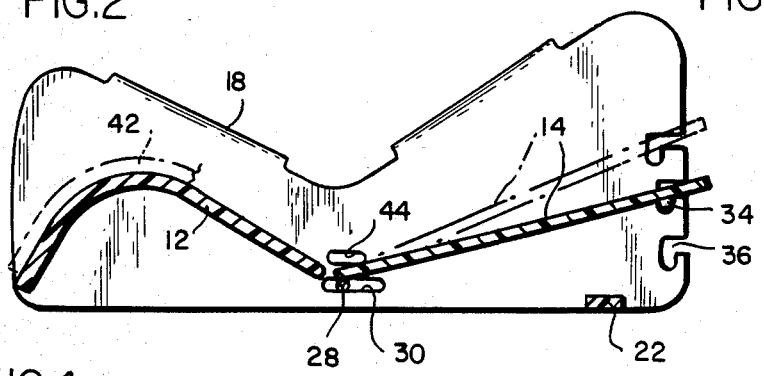
FIG. 4 is a section taken longitudinally midway between the opposite sides showing several angular positions of the back support.

The mobile supporting surface 14 is hingedly connected with one end adjacent an end of the stationary supporting surface by pin means 26—26 which comprise portions at the opposite ends of a rod 28 fastened to the end edge of the mobile supporting surface in parallel relation thereto and to the underside thereof and horizontal slots 30—30 in the side wall panels within which the pin means 26—26 are engaged. The slots 30—30 are so dimensioned as to permit the pin means 26—26 to rotate about a horizontal axis and to move longitudinally in the slots. The mobile supporting surface is angularly movable about the axis of the pin means relative to the stationary supporting surface and can be adjusted to different predetermined positions and supported in a selected position by pin means 32—32 comprising the end portions of a bar 34 fastened to the distal end of the mobile supporting surface. The pin means 32—32 are selectively interengageable with vertically-spaced notches 36 at the edges of the side wall panels. FIG. 4 shows the several angular positions available. To position the mobile supporting surface, the distal end is lifted upwardly to disengage the pin means 32—32 from the bottoms of the notches 36, drawn forwardly from the notches 36 through the openings at the edges of the panels and then lifted or lowered to the notch above or below it, pushed in through the open side of the notches and dropped into the bottom of the notches. The longitudinal motion permitting this is provided by the longitudinal slots 30—30 within which the hinge means are engaged.

There are at the upper edges of the side wall panels 18—18 outwardly-extending flanges 38—38 located above both the stationary and mobile supporting surfaces provided with slots 40—40 for receiving straps for holding the infant in place if required.

Desirably, a flexible, soft pad 42 coextensive with the mobile and stationary supporting surfaces is placed upon these surfaces and is retained in position by means of slots 44—44 situated at the hinge line of the supporting surfaces through which a strap may be placed.

The device as described is desirably made of a material which will provide a glossy surface which can be easily kept clean and which can be subjected to decontamination treatment and from which bacteria can be effectively removed and which is heat-resistant, infrangible, non-absorbent and stain-resistant. For this purpose, a synthetic resin material such as Plexiglas has been found satisfactory.

It should be understood that the present disclosure is for the purpose of illustration only and includes all modifications or improvements which fall within the scope of the appended claims.

What is claimed is:

1. A support for a premature infant comprising means defining a stationary convex surface of such dimensions as to accommodate the leg structure of an infant, means defining a relatively flat mobile surface dimensioned to accommodate the back structure of an infant, vertically spaced supports comprising spaced, parallel side wall panels to which said means defining the stationary surface is fixed, and a hinge for positioning the mobile surface at several predetermined angular positions relative to the stationary surface, said hinge comprising horizontal slots in the side wall panels and pin means at the proximal ends of the flat mobile surface engaged with the slots, said slots being dimensioned to permit rotation of the pin means and movement of the pin means along the slots and wherein the crest of the convex stationary surface occurs at approximately the location of the knee joints.

2. A support according to claim 1 wherein the slope of the convex portion at the proximal side rising to the crest is less than the slope of the convex portion of the distal side descending from the crest.

3. A support according to claim 1 wherein the slope of the convex portion rising at the proximal side to the crest is approximately 30° to 45° and the slope of the convex portion at the distal side descending from the crest is approximately 40° to 65°.

4. A support according to claim 1 wherein the crest is located approximately $\frac{5}{8}$ of the way from the lower edge of the proximal side to the lower edge of the distal side.

5. A support according to claim 1 wherein the lower edge of the mobile surface meets the lower edge of the stationary surface and the mobile surface is angularly movable at the meeting edges about a horizontal axis parallelling said edges.

6. A support according to claim 1 wherein the lower edge portions of the mobile and stationary surfaces are slightly concave so as to merge smoothly.

7. Apparatus according to claim 2 wherein the structure is comprised of a synthetic resin material.

8. A support for a human form comprising a stationary bottom supporting surface for accommodation of the legs and a mobile back-supporting surface for accommodating the back, means supporting the stationary and mobile surfaces with an edge of the mobile back-supporting surface adjacent an edge of the stationary bottom supporting surface, said means comprising spaced, parallel side wall panels coextensive in length with the stationary and mobile supporting surfaces, said stationary bottom supporting surface being fixed at its opposite edges to the respective side wall panels, hinge means connecting the end of the mobile back supporting surface adjacent the stationary bottom surface for angular movement relative to the stationary bottom supporting surface between the side wall panels to enable raising or lowering the back supporting surface, means at the distal end of the back supporting surface engageable with means on the side wall panels to support the back supporting surface at a selected angle, and a flexible pad positioned on the back and leg supporting surfaces, said side wall panels containing slots at the junction of the leg supporting surface with the back supporting surface and a strap threaded through the slots transversely of the structure for holding the flexible pad in position.

* * * * *